US006555280B2

(12) United States Patent
Horikoshi et al.

(10) Patent No.: US 6,555,280 B2
(45) Date of Patent: Apr. 29, 2003

(54) COLOR TONER FOR FLASH FIXING

(75) Inventors: Yuzo Horikoshi, Kawasaki (JP); Katsuji Ebisu, Kawasaki (JP); Takahiro Kashikawa, Kawasaki (JP); Katsura Sakamoto, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/978,208

(22) Filed: Oct. 17, 2001

(65) Prior Publication Data

US 2003/0044710 A1 Mar. 6, 2003

(30) Foreign Application Priority Data

Mar. 30, 2001 (JP) ..... 2001-102439

(51) Int. Cl.[7] ..... G03G 9/08; G03G 13/20

(52) U.S. Cl. ..... 430/108.21; 430/111.4; 430/124

(58) Field of Search ..... 430/111.4, 108.21, 430/124, 108.1

(56) References Cited

U.S. PATENT DOCUMENTS 4,699,863 A * 10/1987 Sawatari et al. ..... 430/97
5,116,711 A 5/1992 Kobayashi et al.
5,432,035 A 7/1995 Katagiri et al.
5,582,950 A * 12/1996 Katagiri et al. ..... 430/137
5,814,427 A * 9/1998 Murofushi et al. ..... 430/109

FOREIGN PATENT DOCUMENTS

| | | |
|---|---|---|
| JP | 61-132959 | 6/1986 |
| JP | 63-301960 | 12/1988 |
| JP | 6-118694 | 4/1994 |
| JP | 6-348056 | 12/1994 |
| JP | 7-191492 | 7/1995 |
| JP | 8-120186 | 5/1996 |
| JP | 9-320638 | 12/1997 |
| JP | 10-39535 | 2/1998 |
| JP | 2000-147824 | 5/2000 |

* cited by examiner

*Primary Examiner*—John Goodrow
(74) *Attorney, Agent, or Firm*—Armstrong Westerman & Hattori, LLP

(57) ABSTRACT

A color toner to which flash light is applied and is fixed on a recording medium at least includes a binding resin, a colorant, and a infrared absorbent. PAS intensity thereof obtained from integration of infrared PAS spectrum obtained based on photoacoustic spectroscopy (PAS) analytical measurement through a range between 800 and 2000 nm is in a range between 0.01 and 0.2 assuming that the value of carbon black is 1.

8 Claims, 4 Drawing Sheets

COLOR TONER FOR FLASH FIXING

BACKGROUND OF THE INVENTION

1. Field of the Invention

The present invention relates to a color toner used for performing image formation using an electrophotographic method, and, in particular, to a color toner to be fixed on a recording medium using optical energy from flash light.

2. Description of the Related Art

The electrophotographic method is a technology currently widely used in image formation apparatuses, such as a copying machine, an electrophotographic facsimile, and an electrophotographic printer. As the electrophotographic method, generally a form using a photoconductive insulator is used, as disclosed by U.S. Pat. No. 2,297,691, etc. In this form, an electrostatic latent image is formed, by applying light, such as that of a laser or an LED, on a photoconductive insulator electrified by corona electric discharge or an electric charge supply roller. Then, the above-mentioned electrostatic latent image is developed by a resin powder called toner (called colorant) colored by a pigment or a paint which adheres thereto, and, thus, a visualized toner image is obtained therefrom. Then, this toner image is transferred onto a recording medium, such as a paper or a film. However, since the toner image at this time is only a powder image which is only put on the recording medium, this should be fixed onto the recording medium. Then, as a last process, after fusing the toner on the recording medium by heat, pressure, light, etc., it is solidified, and the toner image fixed onto the recording medium is finally obtained.

Thus, fixing of toner is such as fusing it by a heat, the toner being a powder generally having a thermoplastic resin (referred to as a binding resin, hereinafter) as a main ingredient, and adhering onto a recording medium as mentioned above. As systems for this purpose, a heat roll system in which a recording medium having had a toner image formed thereon is heated and pressurized directly by a roller, and a flash fixing system in which a toner is fixed onto a recording medium by irradiating it with flash light, such as that from a xenon flash lamp, are well known.

The above-mentioned flash fixing system is a system in which optical energy from a glint of light (flash light) of a discharge tube, such as a xenon flash lamp is converted into thermal energy, and, thereby, a toner is fused, and fixed on a recording medium.

As compared with the above-mentioned heat roll system, this flash fixing system has the following features, when it is used in an image formation apparatus:

(1) Since it is non-contacting fixing, the resolution of a toner powder image formed on a photoconductive insulator layer is not degraded thereby.

(2) No warming up time is needed after beginning of power supply, and, thus, quick starting is possible.

(3) Material or thickness of a recording medium, such as a paper with paste, a pre-printed paper, a paper having a different thickness, has no influence on the fixing performance.

A process in which a toner is fixed onto a recording medium by the flash fixing method is as follows:

Flash light emitted from a discharge tube is absorbed by a toner image on a recording medium (powder image), and is changed into thermal energy. Thereby, the toner increases in temperature, is softening and fused, and is stuck onto the recording medium. The temperature falls after irradiation of flash light is finished, the fused toner then solidifies, and is fixed onto the recording medium.

However, a xenon flash lamp generally used, for example, as a discharge tube for the flash fixing, emits light in a range between 400 nm through 1400 nm in wavelength, and especially, has a remarkably a high light emission intensity in a range between 800 nm through 1400 nm of a near-infrared wavelength region, compared with the light emission intensity in the range between 400 nm through 800 nm of visible region. By this reason, it is required that a toner on which flash fixing is performed should have a high absorbance for the light of the near-infrared wavelength region.

However, generally, the binding resin which is the main ingredient of the toner has a very low absorbance for the visible region and the near-infrared region. Moreover, when the colorant is of black, it has a high absorbance for the visible region and near-infrared region. However, when the colorant is of a color toner, such as yellow, cyan, magenta, red, blue or green, it has a some absorbance for the visible region but has a low absorbance for the near-infrared region.

Therefore, it is difficult to properly fix a color toner containing the binding resin and a colorant for a color other than monochrome one, by such flash light as that used for fixing a black toner. Therefore, in order to fix a color toner, it is necessary to apply strong optical energy thereto.

Then, in order to reduce optical energy needed for fixing a color toner on a recording medium by flash light, a technology has been proposed in which an infrared absorbent having an absorbance for a light emission wavelength region of a xenon flash lamp. For example, Japanese Laid-Open Patent Applications Nos. 61-132959, 6-118694, 7-191492 and 2000-147824 disclose making a toner for the flash fixing contain a compound of a family of aminium, a compound of a family of diimonium, or a compound of a family of naphthalocyanine. Moreover, Japanese Laid-Open Patent Application No. 6-348056 discloses a technology of making resin particles containing an infrared absorbent of a family of anthraquinone, a family of polymethine, or a family of cyanine adhere to a toner surface. Furthermore, Japanese Laid-Open Patent Application No. 10-39535 discloses a technology of improving a fixing performance of a color toner with flash light by making tin oxide or indium oxide contain in the toner.

According to the above-described technology, performance of conversion of optical energy into thermal energy is improved by improving fusion performance of the binding resin which is the main ingredient of a color toner by adding the infrared absorbent thereto.

However, the binding resin cannot yet be fused fully only by addition of the above-mentioned infrared absorbent. Moreover, the above-mentioned compound of a family of aminium, compound of a family of diimonium, or the like, preferably used as the infrared absorbent, is colored by itself. Thereby, it may have a bad influence on the saturation, hue or the like of a color image obtained after being fixed onto a recording medium when this is used in a large amount. Therefore, the amount of the infrared absorbent used preferably should be reduced as possible.

As mentioned above, in the related art, in order to fix a color toner positively by flash light, still high optical energy is needed.

SUMMARY OF THE INVENTION

The present invention has been devised in consideration of the above-mentioned situation, and, an object of the present invention is to provide a color toner for flash fixing by which formation of a superior printed image can be achieved while aiming at reduction of optical energy required therefor.

A color toner according to the present invention includes, at least, a binding resin, a colorant and an infrared absorbent, wherein the color toner is fixed on a recording medium by flash light, and PAS intensity thereof obtained from integration of a infrared PAS spectrum obtained according to photoacoustic spectroscopy (PAS) analytical measurement through a range between 800 and 2000 nm falls within a range between 0.01 and 0.2 assuming that the value of carbon black is 1.

The above-mentioned photoacoustic spectroscopy (PAS) analyzing method is a method for detecting, finally by a pressure change, a periodic heat change occurring due to application of intermittent light (flash light) on a sample. Measurement by in-situ (spot) is possible by this detecting method.

Specifically, the PAS analyzing method used in the present invention is as follows: When a modulated infrared is absorbed by the sample, the heat corresponding to incident light is generated. Since this generated heat causes a pressure change in a surrounding gas layer, this change is detected by a high sensitivity microphone. Then, a spectrum same as an ordinary infrared spectrum is obtained by carrying out Fourier transform thereof.

As mentioned above, according to the present invention, a color toner having the PAS intensity obtained from integration of the infrared PAS spectrum obtained according to the photoacoustic spectroscopy (PAS) analytical measurement through a range between 800 and 2000 nm which falls within a range between 0.01 and 0.2 assuming that the value of carbon black is 1 has an excellent fixing performance. This was proved by an actual evaluating experimentation which will be described later. Fixing of such a color toner can be positively performed only with a low optical energy equivalent to the energy of the flash light required for performing image fixing only by a black toner in the related art.

In addition, since a light-to-heat conversion efficiency in the infrared region of a color toner having the above-mentioned PAS intensity less than 0.01 is low, sufficient fixing performance is not obtained. Moreover, although a sufficient fixing performance is obtained when the above-mentioned PAS intensity is larger than 0.2, as a large amount of the infrared absorbent is needed for making the PAS intensity thus increase, adverse influence of reducing the saturation of a resulting color image obtained after fixing it, may occur, as mentioned above.

According to the present invention, a color toner by which the optical energy required for flash fixing can be effectively reduced is obtained. Such a color toner can be positively fixed only with a weak optical energy which might provide a poor fixing performance in the related art. Since the amount of the infrared absorbent used can thus be controlled, the clear color image formation without degradation of the color image obtained after fixing can be obtained.

The PAS intensity of the color toner may be preferably set in a range between 0.2 and 0.9 times the PAS intensity of a black toner which is fixed simultaneously therewith.

Thereby, the color toner which is fixed simultaneously with the black toner on the recording medium in an image formation apparatus shows a satisfactory fixing performance. That is, the fixing performance of the color toner and black toner can be made equivalent by making the difference in the PAS intensity between the color toner and black toner fall within a predetermined range.

When the PAS intensity of the color toner is less than 0.2 times the black toner, and flash fixing is carried out with the energy which provides a satisfactory fixing performance for the black toner, the color toner comes to thus be fixed in poor fixing performance. When flash fixing is carried out with the energy which provides a satisfactory fixing performance for the color toner, voids may be generated in the black toner as a result of it being melted much by this superfluous optical energy. Thereby, the image quality may be degraded. Thus, in case the PAS intensity of the color toner is less than 0.2 times the black toner, it is difficult to fix the color toner and black toner simultaneously in a satisfactory fixing condition.

When the PAS intensity of the color toner is larger than 0.9 times that of the black toner, satisfactory fixing performance can be obtained for both the color toner and black toner simultaneously. However, in this case, a very large amount of the infrared absorbent should be added in order to improve the PAS intensity, and thereby, adverse influence of degrading the saturation of the resulting color image or the like may occur.

According to the present invention, even using the color toner simultaneously with the black toner to be fixed on a recording medium, the color toner provides a satisfactory fixing performance.

The PAS intensity of the color toner may be preferably set in a range between 0.2 and 5 times the PAS intensity of another color toner which is fixed simultaneously therewith.

Thereby, the first color toner which is fixed simultaneously with the second color toner on the recording medium in an image formation apparatus shows a satisfactory fixing performance. That is, the fixing performance of the first and second color toners can be made equivalent by making the difference in the PAS intensity between these color toners fall within a predetermined range.

When the PAS intensity of one (first) color toner is less than 0.2 times another (second) color toner, and flash fixing is carried out with the energy which provides a satisfactory fixing performance for the second toner, the first color toner thus comes to be fixed in poor fixing performance. When flash fixing is carried out with the energy which provides a satisfactory fixing performance for the first color toner, voids may be generated in the second color toner as a result of it being melted much by this superfluous optical energy. Thereby, the image quality may be degraded. Thus, in case the PAS intensity of one color toner is less than 0.2 times that of another color toner, it is difficult to fix both color toners simultaneously in a satisfactory fixing condition. On the contrary, when the PAS intensity of one color toner is larger than five times that of another color toner, it is not possible to fix both the color toners simultaneously in satisfactory fixing condition.

According to the present invention, even using the different color toners simultaneously to be fixed on a recording medium, each color toner provides a satisfactory fixing performance.

The infrared absorbent may preferably comprise at least two infrared absorbents having different absorption wavelength spectrums in a range between 800 and 2000 nm in wavelength.

Thereby, the absorbance of a toner in the range between 800 and 2000 nm in wavelength can be improved, the PAS intensity of the color toner can be improved by this, and a satisfactory fixed image can be realized. Problems, such as poor saturation of a fixed image mentioned above occurring when the utilization efficiency of the optical energy of incident light is not satisfactory even when the additive amount of a single sort of infrared absorbent is increased, since the above-mentioned infrared absorbent has an absorption peak only in a specific range. The optical energy utilization efficiently can be improved by using together two or more sorts of infrared absorbents having different absorption wavelength spectrums at once, and the problem of deterioration of the fixing quality of a resulting image by using a single sort of infrared absorbent so much can be eliminated.

Thus, absorbance of toner in the range of 800–2000 nm wavelength can be improved positively, the PAS intensity of the color toner can be improved by this, and a good fixing image can be realized.

Since two or more infrared absorbents are used together, flash light can be more efficiently utilized and optical energy can be reduced effectively. Furthermore, since the amount of the infrared absorbents used can be controlled in total, adverse influence on color image formation for hue or saturation of resulting image can be more positively controlled.

As the composition of the infrared absorbent to be added to the toner, a first infrared absorbent (A) which has an absorption peak in the range between 800 and 1100 nm in wavelength, and a second infrared absorbent (B) which has an absorption peak in the range between 1100 and 2000 nm in wavelength may be used simultaneously.

Furthermore, the above-mentioned object of the present invention can be achieved by an image forming method including steps in which a color toner which at least contains a binding resin, a colorant, and an infrared absorbent is irradiated by flash light, and thus, the toner is fixed onto a recording medium, wherein the PAS intensity (S) of the color toner obtained from integration of an infrared PAS spectrum obtained according to photoacoustic spectroscopy (PAS) analytical measurement through a range between 800 and 2000 nm and an optical energy (E) of the flash light satisfy the requirement of the following formula (1):

$$0.03 \leqq E \cdot S \leqq 0.15 \quad (1)$$

Thereby, a satisfactory fixing performance can be obtained while few voids are generated in the toner in forming a color printed image.

The above-mentioned formula (1) means that, in case the optical energy of the flash light is sufficiently high, satisfactory fixing can be performed even when the PAS intensity of the color toner is somewhat low, while, a satisfactory fixing performance can be obtained when the PAS intensity is sufficiently high even when the flash light energy is somewhat low.

That is, fixing cannot be performed satisfactorily in case the above-mentioned product E·S is less than 0.03, while, when it exceeds 0.15, since this means that a superfluous energy is applied to the color toner, voids may be generated therein, and, thus, a satisfactory printed color image cannot be obtained, either. That is, this inventor etc. found out that a satisfactory fixed (printed out) image can be obtained, even with a reduced optical energy, when flash fixing is performed in such a manner that the requirement of the above-mentioned formula (1) be satisfied. In order to realize image formation which satisfies such a requirement, it is preferable to use the above-mentioned color toner according to the present invention.

By using the above-mentioned color toner, the preferable flash-fixing image forming method for fixing a color toner image on a recording medium by exposure by flash light is realizable, and by this method, energy of flash light may be made into a range between 0.5 and 2.5 J/cm$^2$, and the light application time thereof may be set in a range between 500 and 3000 $\mu$s. Thus, the stabled fixing performance can be obtained with a low optical energy without generation of voids in the toner, as compared with the related art.

BRIEF DESCRIPTION OF THE DRAWINGS

Other objects and further features of the present invention will become more apparent from the following detailed description when read in conjunction with the following accompanying drawings.

DETAILED DESCRIPTION OF THE PREFERRED EMBODIMENTS

Figure 1:
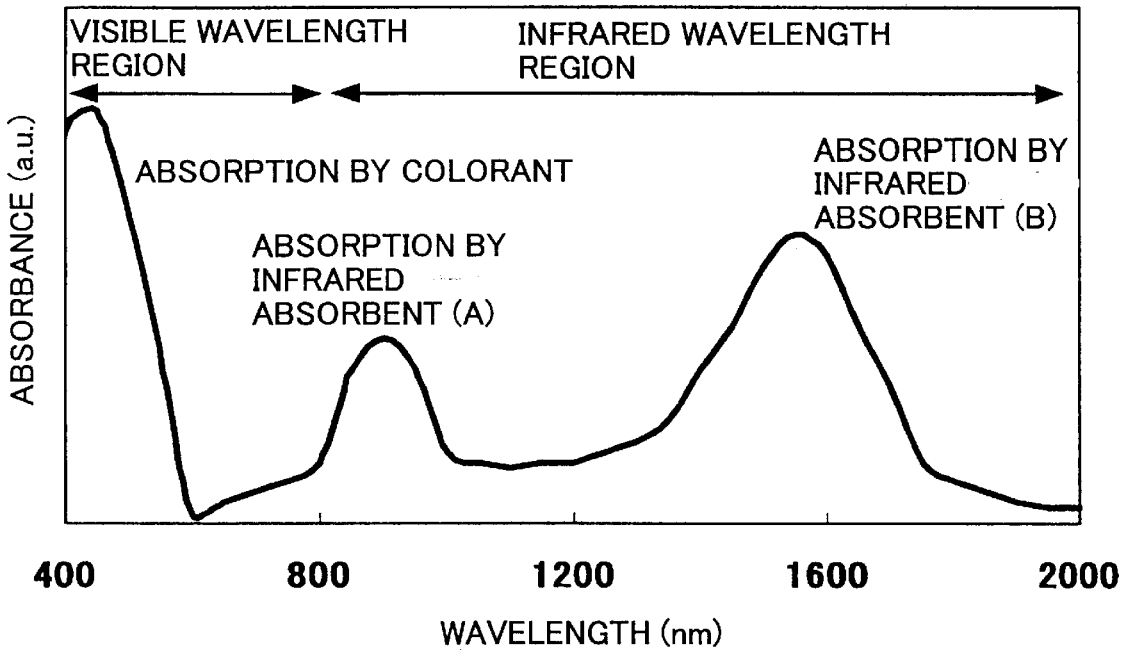
FIG. 1 shows absorbance characteristic of a color toner (red toner) which is an example of the resent invention.

Hereafter, color toners according to the present invention will be described in detail. A color toner for flash fixing according to the present invention contains a binding resin, a colorant, and an infrared absorbent at least. This color toner is such that the PAS intensity obtained through integration of the infrared PAS spectrum obtained based on photoacoustic spectrum (PAS) analysis measurement through the range between 800 and 2000 nm falls within a range between 0.01 and 0.2 assuming that the value for carbon black is 1. Such a color toner can be preferably used in an image formation apparatus, employing an electrophotographic method, such as a copying machine, a photoelectric printer, or a facsimile machine.

The PAS intensity of a toner can be obtained as follows, for example: After taking a toner onto a stainless steel plate and setting a PAS measurement unit, the atmosphere is replaced by helium gas on the condition of 10 ml/s and 10 s, and measurement is made using an FT-IR (made by Mattson Co., Ltd.) as an apparatus having a predetermined Fourier transform function. The number of times of integration is 200, and thus, the infrared PAS spectrum is obtained. Then, the thus-obtained infrared PAS spectrum is integrated through the range between 800 through 2000 nm. Thus, the PAS intensity is obtained. The PAS intensity of carbon black is used as a value of a reference substance having a high absorbance through a wide wavelength range. Then, the PAS intensity of carbon black is assumed as 1, and, thereby, the PAS intensity of the color toner is obtained as a relative intensity The above-mentioned infrared absorbent has a function of converting optical energy of flash light into thermal energy, in a fixing unit provided in an image formation apparatus. This infrared absorbent is added to the toner originally in order to promote fusion of the binding resin. A general infrared absorbent absorbs a light of a wavelength in a range between 800 and 2500 nm, and converts the optical energy thereof into thermal energy. For example, when it is a naphthalocyanine compound which can be used preferably for a color toner in an embodiment of the present invention, the infrared of the range between approximately 800 and 1100 nm is absorbed thereby.

The inventors of the present invention, etc. repeated research wholeheartedly so as to search for an infrared absorbent which has absorbing power for a wide range between 800 and 2500 nm, more preferably, a range between 800 and 2000 nm. However, a single infrared absorbent which has absorbing power for a wide wavelength range was not able to be found out. That is, in case a single infrared absorbent is used, it is not possible for a color toner to have a sufficient fixing performance unless a very large amount thereof is added so as to achieve a very high concentration thereof.

However, it was found out that, by dividing this wide wavelength range, the fixing performance of a color toner could be improved with low optical energy required as compared with a conventional method, by a combined use of, for example, a first infrared absorbent which has a absorption peak in the range between 800 and 1100 nm in wavelength and a second infrared absorbent (B) which has an absorption peak in the range between 1100 and 2000 nm in wavelength, without increasing the concentration of the infrared absorbent in total.

Further, such a color toner has the PAS intensity, obtained as a result of the infrared PAS spectrum being integrated through the range between 800 and 2000 nm, falling within the range between 0.01 and 0.2 assuming that the value for carbon black is 1.

Moreover, in an image formation apparatus which performs color image formation, a black toner and a color toner are fixed simultaneously in a fixing unit. In this case, the color toner and black toner can be efficiently fixed satisfactorily with a reduced the optical energy used for flash fixing, by setting up the above-mentioned PAS intensity of the color toner 0.2 through 0.9 times the PAS intensity of the black toner which is fixed simultaneously therewith.

Furthermore, in an image formation apparatus which performs color image formation, a color toner of a certain color (for example, red), and a color toner of another color (for example, blue) may be fixed simultaneously by a fixing unit. In this case, each color toner can be efficiently fixed satisfactorily, with a reduced optical energy used for flash fixing, by setting up the above-mentioned PAS intensity of the one color toner 0.2 to 5 times the PAS intensity of the other color toner which is fixed simultaneously therewith.

Toners having a predetermined relation in the PAS intensity therebetween as mentioned above can be manufactured by appropriately adjusting color toners according to the present invention each containing at least two infrared absorbents having different absorbent wavelength spectrums in the range in wavelength between 800 and 200 nm.

Figure 2:
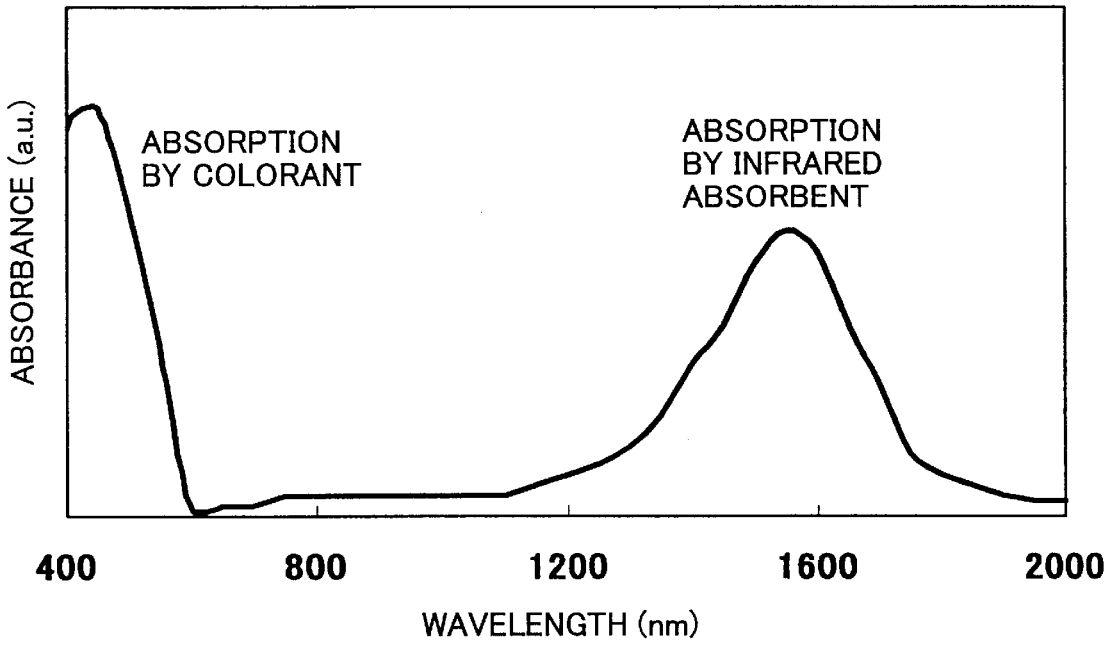
FIG. 2 shows absorbance characteristic of a color toner (red toner) in the related art in which only one infrared absorbent is added.

FIG. 1 shows an absorbance characteristic of a color toner (red toner) which is an example of the present invention, and FIG. 2 shows an absorbance characteristic of a color toner (red toner) in the related art in which a single infrared absorbent is added.

In FIG. 1, since both the first infrared absorbent (A) which has an absorption peak in the range between 800 and 1100 nm in wavelength and the second infrared absorbent (B) which has an absorption peak in the range between 1100 and 2000 nm in wavelength are contained in the toner, two absorption peaks are formed accordingly as shown in the figure. Therefore, the infrared light can be utilized efficiently.

On the other hand, in FIG. 2, since only a single absorption peak is formed in the infrared region, it cannot utilize infrared light efficiently. Therefore, in order to make this one peak high, it is necessary to add a large amount of the infrared absorbent.

As the above-mentioned first infrared absorbent (A) which can be used in a color toner according to the present invention, for example, a compound of a family of naphthalocyanine may be used as the most preferable material. As the second infrared absorbent (B), for example, a compound of a family of aminium or a compound of a family of diimonium may be used as the most preferable material.

The compound of a family of naphthalocyanine can be expressed by the following general chemical formula 1:

Chemical Formula 1

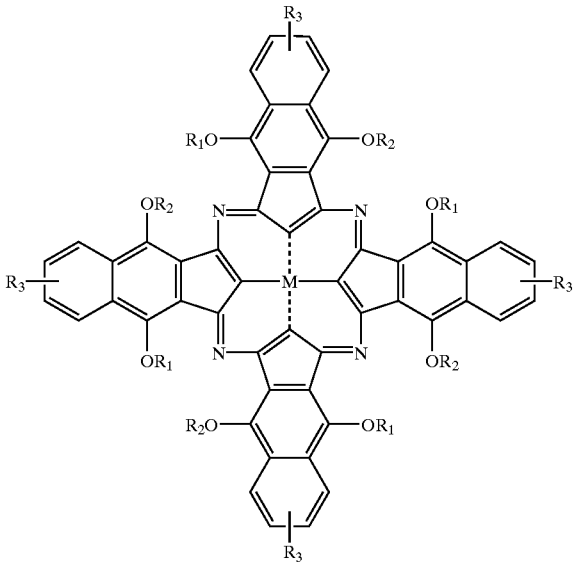

where M expresses a metal, a metal oxide or a metal halide, and each of R1 through R3 expresses a hydrogen atom, a halogen atom, an alkyl group, an allyl group, an alkoxyl group, a nitro group, or a carboxyl group.

The compound of a family of aminium can be expressed by the following general chemical formula 2:

Chemical Formula 2

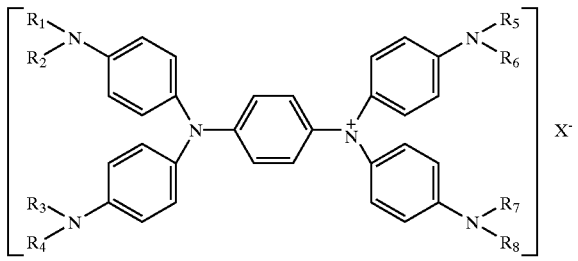

where: each of R1 through R8 expresses a hydrogen atom, a halogen atom, an alkyl group, an allyl group, an alkoxyl group, a nitro group, or a carboxyl group; and $X^-$ expresses an anion.

The compound of a family of diimonium is expressed by the following general chemical formula 1:

Chemical Formula 3

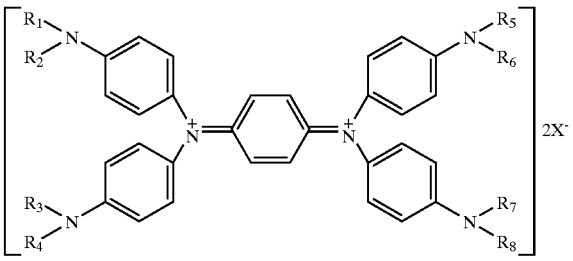

wherein each of R1 through R8 expresses a hydrogen atom, a halogen atom, an alkyl group, an allyl group, an alkoxyl group, a nitro group, or a carboxyl group, and $X^-$ expresses an anion.

As infrared absorbents other than the above, a compound of a family of polymethine, a compound of a family of cyanine, a compound of a family of anthraquinone, a compound of a family of phthalocyanine, a metal complex compound of dithiol-nickel complex or azocobalt complex, a compound of a family of squalirium, tin oxide, ytterbium oxide, phosphorylated ytterbium, or the like may be used.

It is preferable to use a plurality of the above-mentioned kinds of infrared absorbents together, and, also, in particular, it is further preferable to use together an infrared absorbent having an absorption peak in the range between 800 nm and 1100 nm in wavelength and an infrared absorbent having an absorption peak in the range between 1100 nm and 2000 nm in wavelength.

According to the present invention, with respect to a toner of 100 weight part, the infrared absorbent in the range between 0.1 and 10 weight parts, more preferably, in the range between 0.1 and 3 weight parts, is preferable to be added in the color toner of the embodiment of the present invention. This amount to be added means a total amount of infrared absorbents used together.

As described above, as the amount of infrared absorbent to be added increases, the hue of toner image obtained after being fixed may shift from the original hue of the contained colorant. Thereby, the saturation of the image may be degraded. However, according to the present invention, it is possible to control the total amount of infrared absorbent(s) to be added in comparison to the related art. That is, if a sufficient infrared absorbing power should be obtained from a single infrared absorbent, a large amount thereof should be added. Thereby, the above-mentioned problem in that the image quality of the fixed image is degraded may occur. However, by using a plurality of sorts of infrared absorbents having different absorption wavelength spectrums together according to the present invention, it becomes possible to improve the infrared absorbing power even with a reduced amount of total infrared absorbents in comparison to the case a single infrared absorbent is used. Furthermore, since these different infrared absorbents have different colors, the problem of image degradation after being fixed can also be effectively reduced.

A conventional thermoplastic resin may be used as a binding resin contained in a color toner according to the present invention. For example, epoxy resin, styrene acrylic resin, polyamide resin, polyester resin, polyvinyl resin, polyurethane resin, polybutadiene resin, and so forth, each having a glass transition temperature in the range between 40 and 80° C., and a softening point in the range between 80 and 140° C., may be used solely or in any mixture thereof. As occasion demands, wax (for example, carnauba, montan, polyethylene, amaid, polypropylene, or the like) may be added to this binding resin.

For a colorant which may be contained in the color toner in the embodiment of the present invention, there is no special limitation, and any known colorant may be used therefor. For example, a red pigment of a family of monoazo, a yellow pigment of a family of disazo, a magenta pigment of a family of quinuclidinone, anthraquinone dye, dye of a family of nigrosine, quaternary ammonium salt, a metallic complex salt of a family of monoazo, or the like, may be used. Further, it is also possible to appropriately combining some of them to be used.

As the colorant, specifically, for example, aniline blue (C. I. No. 50405), chalco-oil blue (C. I. No. azoic Blue3), chrome yellow (C. I. No. 14090), ultra marine blue (C. I. No. 77103), du pont oil red (C. I. No. 26105), quinoline yellow (C. I. No. 47005), methylene blue chloride (C. I. No. 52015), phthalocyanine blue (C. I. No.74160), malachite green octhalate (C. I. No. 42000), edible red No. 2 (amaranth, C. I. No. 16185), edible red No. 3 (erythrosine, C. I. No. 45430) and edible red No. 40 (arlared AC, C. I. No. 16035), edible red No. 102 (new cokesine, C. I. No. 16255), edible red No. 104 (phroxine, C. I. No. 45410), edible red No. 105 (rose bengal, C. I. No. 45440) 105, edible red No. 106 (acidred, C. I. No. 45100), edible yellow No. 4 (Tartrazine, C. I. No. 19140), edible yellow No. 5 (sunset yellow FCF, C. I. No. 15985), edible green No. 3 (first green FCF, C. I. No. 42053), the edible blue No. 1 (brilliant blue FCF, C. I. No. 42090), edible blue No. 2 (indigo carmine, C. I. No. 73015), or the like may be used.

The content of the above-mentioned colorant is in the range between 0.1 and 20 weight parts, and, preferably, in the range between 0.5 and 10 weight parts, with respect to 100 weight parts of the toner.

As described above, in the case where the whole color toner is assumed to be of 100 weight parts in the color toner according to the present invention, the following composition thereof is recommended, for example:

- the binding resin: in the range between 75 and 95 weight parts;
- the colorant: in the range between 0.1 and 20 weight parts, and, preferably, in the range between 0.5 and 10 weight parts; and,
- the infrared absorbents in total: in the range between 0.1 and 10 weight parts, and, preferably, in the range between 0.1 and 3 weight parts.

Furthermore, to the color toner according to the present invention, an electrification control agent may be added for the purpose of giving electrification property thereto, and/or reducing change in the amount of electrification due to difference in temperature/humidity environment. As the electrification control agent, substance of colorlessness or light color is recommended.

As the electrification control agent, a known electrification control agent having positive electrification property or negative electrification property, such as quaternary ammonium salt compound, salicylic acid compound, complex of a family of boric acid, compound of a family of carboxylic acid, or the like, may be used.

The color toner according to the present invention can be manufactured according to the same manufacturing process as usual. At least, a binding resin, a colorant, and two or more sorts of infrared absorbents having different absorbance characteristics in the range of wavelength between 800 and 2000 nm are prepared first. Further, an electrification control agent and wax are added as occasion demands. Thus, raw materials are prepared. Then, the raw materials are kneaded and dispersed uniformly, by, for example, a pressurization kneader, a rolling mill, an extrusion machine, or the like. Then, they are ground, and finely ground, by, for example, a grinder, a jet mill, or the like, and, then, are classified by an air classification machine, or the like. Thus, a color toner having a desired particle-size distribution is obtained.

In addition, in the kneading, the infrared absorbents) and the electrification control agent may be kneaded into separate resins, and, then, they may be kneaded together again, as disclosed in Japanese Laid-Open Patent Application No. 7-191492, for example.

Furthermore, in order to improve the mobility of the color toner according to the present invention, inorganic fine particles (referred to as an external additive, hereinafter) may be coated on the toner surfaces. As the external additive, those each having a particle diameter in the range of 2 nm and 500 nm, preferably, in the range between 5 nm and 200 nm, may be used. Moreover, it is preferable that this has a specific surface area according to the BET method falling in the range between 20 $m^2/g$ and 500 $m^2/g$.

The rate of the external additive mixed into the color toner according to the present invention is in the range between 0.1 and 5 weight parts, more preferably, in the range between 0.1 and 2.0 weight parts with respect to 100 weight parts of the toner. As the external additive, silica, alumina, titanium oxide, barium titanate, magnesium titanate, calcium titanate, strontium titanate, zinc oxide, quartz sand, clay, mica, wollastonite, diatomite, chromium oxide, cerium oxide, red ocher, diantimony trioxide, magnesium oxide, zirconium oxide, barium sulfate, barium carbonate, calcium carbonate, silicon carbonate, silicon nitride, or the like, may be used in a form of fine particles. Among them, it is preferable to use silica particles. In addition, the external additive may be used after being undergone processing of the surfaces thereof such as to make the surfaces thereof hydrophobic.

Hereafter, color toners in embodiments of the present invention will be illustrated more concretely.

The color toners in the embodiments 1 through 7 according to the present invention were manufactured. There, the case where the above-mentioned infrared absorbent is used independently, and comparison examples in which the additive amount were changed will also be mentioned.

Embodiment 1

Binding resin: polyester resin (NCP-001J; made by Japan Carbide Co., Ltd.) 91 weight parts;

Infrared absorbent (A): naphthalocyanine compound (YKR-5010; made by Yamamoto Chemicals, INC.) (maximum absorption wavelength: 880 nm) 1 weight part;

Infrared absorbent (B): aminium salt compound (NIR-AMl; made by Teikoku Chemistry Industry, Co. Ltd.) (maximum absorption wavelength: 1550 nm) 1 weight part;

Colorant: copper phthalocyanine pigment (Lionol Blue ES; made by TOYO INK MFG. CO., LTD.) 5 weight parts;

Negative electrification control agent: E-89 (made by Orient Chemistry, Co. Ltd.) 2 weight parts After supplying these materials into a hershel mixer and performing preliminary kneading them, which are then kneaded by an extruder, they are roughly ground by an hammer mill. Then, the thus-obtained product is finely ground by a jet mill, and is classified by an air classifier. Thus, a blue toner whose volume average particle diameter is approximately 8.5 micrometers was obtained. Subsequently, 0.5 weight parts of hydrophobic silica fine particles (H2000/4, made by Clariant, Co., Ltd.) were added as the external additive, and, an external adding process is performed by a henshel mixer. Thereby, a blue toner in which the external additive was coated on the surfaces thereof was obtained.

The PAS intensity was measured for the thus-obtained blue toner. The procedure of measurement is as follows: After taking the blue toner onto a stainless steel plate, and setting a PAS measurement unit (Photoacustic Model 300, made by MTEC, Co. Ltd.), the atmosphere is replaced by a helium gas on the conditions of 10 ml/s and 10 s, and, then, measurement was made by using an FT-IR (made by Mattson, Co., Ltd.). The number of times of integration was 200, and thus, the infrared PAS spectrum was obtained. Then, this infrared PAS spectrum was integrated through the range between 800 and 2000 nm, and, thus, the PAS intensity was obtained. The PAS intensity of the color toner was obtained as a relative intensity where the PAS intensity of carbon black is regarded as a reference 1, assuming the carbon black as a reference substance. The relative intensity of this blue toner was 0.07.

Next, the above-mentioned blue toner was used for producing a two-ingredient developer, a toner image was formed on a recording medium using a flash fixing printer, and the fixing performance thereof was evaluated.

The two-ingredient developer was produced using a product obtained from mixing, by a ball mill, 4.5 weight parts of the above-mentioned blue toner, and 95.5 weight parts of a magnetite carrier coated by resin of silicon family (made by Kanto Denka Kogyo Co., Ltd.).

Figure 3:
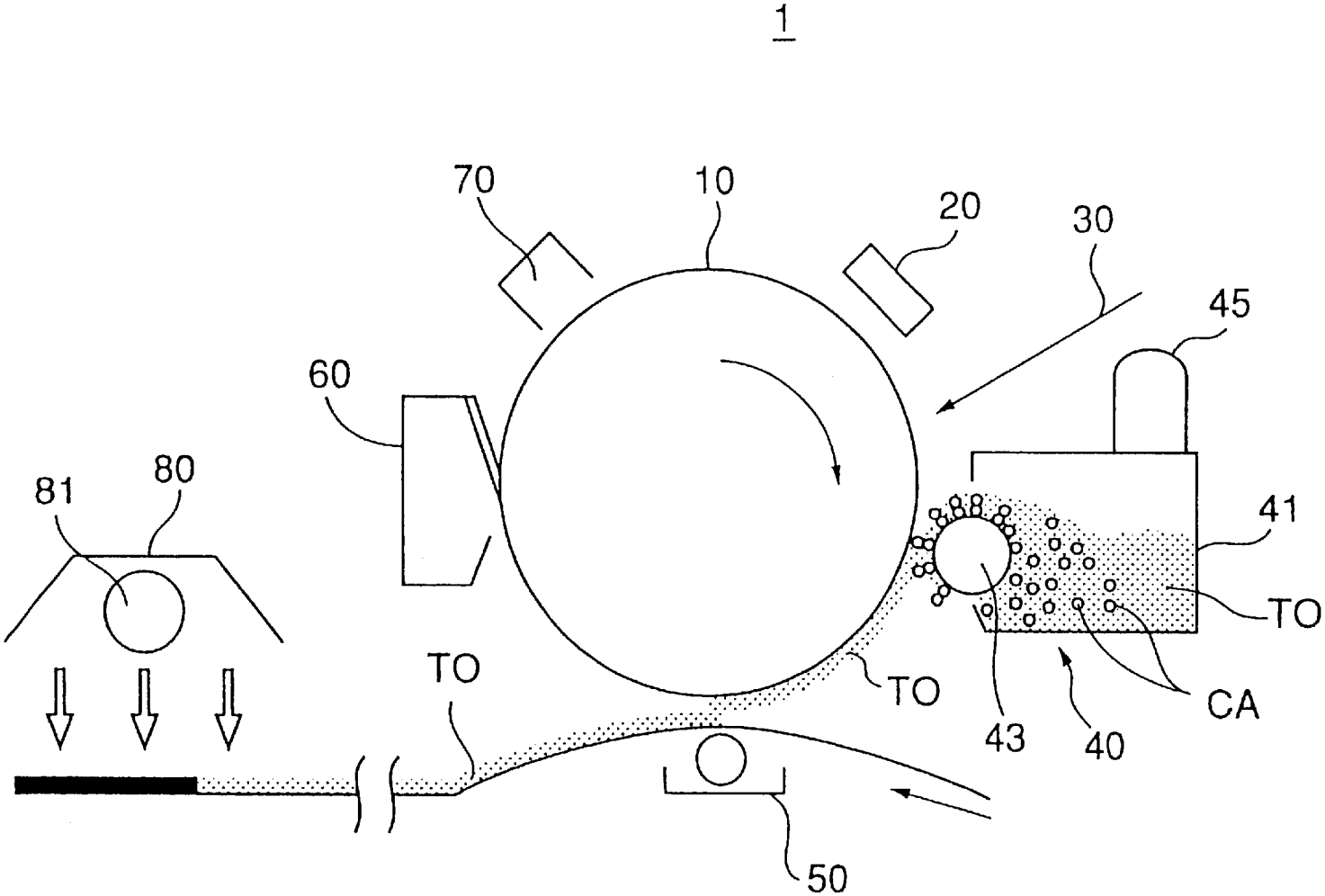
FIG. 3 typically shows a general configuration of a part of an image formation apparatus in a two-ingredient development form according to the present invention.

FIG. 3 illustrates a two-ingredient developing image formation apparatus 1 in one example. This apparatus 1 is of a high-speed development type having a process speed of 1100 mm/s, and includes an electrification unit 20, an exposure unit 30, a development unit 40, a transfer unit 50, a cleaner 60, an electric discharge unit 70, and a flash fixing assembly 80 having a xenon flash lamp 81, and so forth are disposed around a photosensitive body 10 made of amorphous silicon. The development unit 40 includes a developer container 41, a development roller 43, stirring blades not shown in the figure, and so forth, and causes toner particles TO to come into contact with career particles CA in the developer container 41 and thereby a predetermined amount of electrification is given to the toner.

In this embodiment, a bias electric potential applied to the flash lamp was changed using a laser printer (F676D; made by FUJITSU, LTD.) employing a xenon flash fixing form as an image formation apparatus. Thereby, optical energy ,emitted from the flash lamp per unit area of a recording medium (paper) can be changed. There, the optical energy of 1.8 $J/cm^2$ was applied for 1500 $\mu s$. Then, after a powder image of the blue toner on the paper was melted, it was made solidified, and thus, the fixing image was obtained. The fixing performance thereof was evaluated for this fixed image.

The evaluation of the fixing performance was made by tape exfoliation examination. In this examination, by sticking lightly an adhesion tape (Scott mending tape; made by 3 M, Co., Ltd.) onto the fixed image, and a cylindrical block was made to roll thereon, and, thereby, the tape was stuck on the surface of the fixed image by a linear load of 250 g/cm, and after an appropriate time had elapsed, the tape was stripped therefrom. Then, an optical tone ratio expressed by the following formula was obtained using optical tone of the image before and after the tape was stripped therefrom:

Fixing performance (%)=(image tone after tape stripping/image tone before tape stripping)×100

As a result, when the fixing performance on the order of 70% is obtained, the evaluation is determined as satisfactory.

The evaluation result of the blue toner in the above-mentioned embodiment 1 was 90% and thus satisfactory fixing performance was obtained, and, also, no voids due to excess application of the optical energy were generated.

The optical tone of the fixed image was measured as follows: a spectrophotometric color meter (CM-3700d; made by Minolta Camera Co., Ltd.) was used, and reflected light in the range of 400 nm and 800 nm in wavelength was measured, and, then, the absorbance value in wavelength at which the absorbance was highest was regarded as the optical tone.

In addition, since the fixing performance changes when the amount of toner on the paper changes, measurement of the fixing performance was made where the toner amount on the paper is in the range between 0.70±0.05 g/cm$^2$.

Embodiment 2

A blue toner was made in the same manner as that of the embodiment 1 except that the material composition of the color toner was shown below, and the PAS intensity thereof was measured in the same manner. The PAS intensity of the blue toner in the embodiment 2 was 0.05.

Moreover, as a result of performing the same fixing evaluation as that of the embodiment 1, the fixing performance of 80% was obtained, and no voids were generated, either.

Binding resin: polyester resin (NCP-001J; made by Japan Carbide Co., Ltd.) 92 weight parts;

Infrared absorbent (A): naphthalocyanine compound 0.5 weight parts;

Infrared absorbent (B): diimonium salt compound (NIR-IMl; made by Teikoku Chemistry Industry, Co., Ltd.) (maximum absorption wavelength: 1150 nm) 1 weight part;

Colorant: copper phthalocyanine pigment (Lionol Blue ES; made by TOYO INK MFG. CO., LTD.) 5 weight parts;

Negative electrification control agent: E-89 (made by Orient Chemistry Co., Ltd.) 2 weight parts Embodiment 3

A blue toner was made in the same manner as that of the embodiment 1 except that the material composition of the color toner was shown below, and the PAS intensity thereof was measured in the same manner. The PAS intensity of the blue toner in the embodiment 3 was 0.02 with respect to 1 of carbon black.

Moreover, as a result of performing the same fixing evaluation as that of the embodiment 1, the fixing performance of 70% was obtained, and no voids were generated, either.

Binding resin: polyester resin (NCP-001J; made by Japan Carbide Co., Ltd.) 90 weight parts;

Infrared absorbent (A): naphthalocyanine compound 0.1 weight parts;

Infrared absorbent (B): diimonium salt compound 1 weight part;

Colorant: copper phthalocyanine pigment (Lionol Blue ES; made by TOYO INK MFG. CO., LTD.) 5 weight parts;

Negative electrification control agent: E-89 (made by Orient Chemistry Co., Ltd.) 2 weight parts Comparison Example 1

A blue toner was made in the same manner as that of the embodiment 1 except that the material composition of the color toner was shown below, and the PAS intensity thereof was measured in the same manner. The PAS intensity of the blue toner in the comparison example 1 was 0.005 with respect to 1 of carbon black. Moreover, as a result of performing the same fixing evaluation as that of the embodiment 1, the fixing performance as low as 50% was obtained, although no voids were generated. Thus, poor fixing performance was obtained.

This might be because, the PAS intensity of the toner in the comparison example 1 was 0.005, this value was remarkably low as compared with the toner in each embodiment, and, thereby, although the same flash light was applied, the energy utilization efficiency might be bad.

Binding resin: polyester resin (NCP-001J; made by Japan Carbide, Co., Ltd.) 92.95 weight parts;

Infrared absorbent: aminium salt compound 0.05 weight parts;

Colorant: copper phthalocyanine pigment (Lionol Blue ES; made by TOYO INK MFG. CO., LTD.) 5 weight parts;

Negative electrification control agent: E-89 (made by Orient Chemistry, Co., Ltd.) 2 weight parts Comparison Example 2

A blue toner was made in the same manner as that of the embodiment 1 except that the material composition of the color toner was shown below, and the PAS intensity thereof was measured in the same manner. The PAS intensity of the blue toner in the comparison example 2 was 0.21.

Moreover, as a result of performing the same fixing evaluation as that of the embodiment 1, the fixing performance as high as 90% was obtained, although many voids were generated. Accordingly, the total fixing performance was not satisfactory.

It can be seen that, although this comparison example 2 used the two types of infrared absorbents together, the toner was melted excessively when the additive amount thereof was superfluous.

Binding resin: polyester resin (NCP-001J; made by Japan Carbide Co., Ltd.) 73 weight parts;

Infrared absorbent (A): naphthalocyanine compound 10 weight parts;

Infrared absorbent (B): diimonium salt compound 10 weight parts;

Colorant: copper phthalocyanine pigment (Lionol Blue ES; made by TOYO INK MFG. CO., LTD.) 5 weight parts;

Negative electrification control agent: E-89 (made by Orient Chemistry Co., Ltd.) 2 weight parts Furthermore, the following embodiments and comparison examples are those taking into consideration also of a situation in which it was actually fixed in an image formation apparatus, and cases where simultaneous fixing of a color toner and a black toner together was carried out will be mentioned.

Embodiment 4

A black toner (No. 1 black toner) was produced as follows in the same manner as that of the blue toner in the embodiment 1, and the PAS intensity thereof was obtained in the same manner. The PAS intensity of the black toner in the embodiment 4 was 0.1.

Fixing examination was performed in which simultaneous fixing of these two sorts of toners on a paper, i.e., the blue toner in the embodiment 1 and the above-mentioned No. 1 black toner, in the same manner as that of the embodiment 1. Then, the PAS intensity of the blue toner was 0.07 and the PAS intensity of No. 1 black toner was 0.1. The PAS intensity of the blue toner with respect to the PAS intensity of the black toner was 0.7 (=0.07/0.1).

The fixing performance in the present embodiment was such that 90% for the blue toner while 95% for the black toner, and, each thereof did not have voids generating therein. Thus, satisfactory fixing performance was obtained.

[No. 1 Black Toner]

Binding resin: polyester resin (NCP-001J; made by Japan Carbide, Co., Ltd.) 88 weight parts;

Carbon: (#25; made by Mitsubishi Chemical Co., Ltd.) 10 weight parts;

Negative electrification control agent: S-34 (made by Orient Chemistry Co., Ltd.) 2 weight parts Embodiment 5

Except that the blue toner having the PAS intensity of 0.02 (0.2 with respect to that of No. 1 black toner) used in the embodiment 3 was used as the color toner, evaluation was performed in the same manner as that of the above-mentioned embodiment 4. The fixing performance of the present embodiment was such that 70% for the blue toner while 95% for the black toner. Each thereof had no voids generating. Thus, satisfactory fixing performance was obtained.

Comparison Example 3

Except that the following No. 2 black toner (PAS intensity of 0.13) was used as the black toner and the blue toner used in the embodiment 3 having the PAS intensity of 0.02 (0.15 with respect to that of No. 2 black toner) was used as the color toner, and, also, the fixing energy was changed into 2.5 J/cm$^2$, the same evaluation as that of the embodiment 4 was performed. Consequently, although the fixing performance was such that 75% for the blue toner while 95% for the black toner, voids were generated in the black toner. Thus, satisfactory total fixing performance was not obtained.

[No. 2 Black Toner]

Binding resin: polyester resin (NCP-001J; made by Japan Carbide, Co., Ltd.) 83 weight parts;

Carbon: (#25; made by Mitsubishi Chemical Co., Ltd.) 15 weight parts;

Negative electrification control agent: S-34 (made by Orient Chemistry Co., Ltd.) 2 weight parts No.2 black toner used in this comparison example 3 had the large PAS intensity as compared with No. 1 black toner. Therefore, the fixing optical energy preferable for the color toner (blue) of this example might be too strong depending on the kind of the black toner.

That is, for relation between the color toner and black toner used simultaneously, the present inventors etc. confirmed that the PAS intensity of the color toner should be preferably set within approximately 0.2 through 0.9 times the PAS intensity of the black toner fixed simultaneously therewith. Moreover, for a color toner of red, green, magenta, cyan, yellow or the like, the same result was obtained.

Moreover, although any specific embodiment is not shown, relation between color toners was examined by the inventors etc. in the same manner as that of the above-mentioned embodiments 4 and 5 and comparison example 3. Consequently, it was confirmed that the PAS intensity of the color toner should be preferably set within approximately in a range between 0.2 and 5 times the PAS intensity of the other color toner simultaneously used therewith together.

Comparison Example 4

The above-mentioned No. 1 black toner was used as the black toner. Moreover, the blue toner used in the embodiment 1 was used as the color toner. However, each of the amount of the infrared absorbent (A) and the amount of the infrared absorbent (B) added was increased into 5 weight parts, and thus, total 10 weight parts, both added to the blue toner. Other conditions were the same as those of the embodiment 1, and thus, the blue toner was produced. The PAS intensity of this blue toner was 0.095 (0.95 with respect to that of No. 1 black toner).

These toners were evaluated in the same manner as that of the embodiment 4. Consequently, although the fixing performance was 90% for the black toner and 90% for the blue toner, the saturation of the resulting fixed image for the blue toner was degraded, and, thus, a satisfactory fixed image was not obtained.

It can be seen from the present example that, although the fixing performance was improved as the large amounts of infrared absorbents was added, the infrared absorbents colored had adverse influence on the saturation of the fixed image.

The following embodiments and comparison examples will show cases where the optical energy (fixing energy) for performing flash fixing using the toner in the embodiment 1 was changed.

Embodiment 6

Except that the energy of flash light was changed into 0.5 J/cm$^2$ and the light application time was changed into 3000 $\mu$s, evaluation of the toner was performed in the same manner as that of the above-mentioned embodiment 1. In this embodiment, 70% of fixing performance was obtained and no voids were generated. Thus, satisfactory total fixing performance was obtained.

Embodiment 7

Except that the energy of flash light was changed into 2.5 J/cm$^2$ and the light application time was changed into 500 $\mu$s, evaluation of the toner was performed in the same manner as that of the above-mentioned embodiment 1. In this embodiment, 75% of fixing performance was obtained and no voids were generated. Thus, satisfactory total fixing performance was obtained.

Comparison Example 5

Except that the energy of flash light was changed into 0.4 J/cm$^2$ and the light application time was changed into 500 $\mu$s, evaluation of the toner was performed in the same manner as that of the above-mentioned embodiment 1. In this example, 60% of fixing performance was obtained. Thus, poor fixing performance was obtained. It can be inferred that, in this example, the optical energy applied was insufficient.

Comparison Example 6

Except that the energy of flash light was changed into 3.1 J/cm$^2$, evaluation of the toner was performed in the same manner as that of the above-mentioned embodiment 1. In this example, voids were generated. Thus, satisfactory total fixing performance was not obtained. It can be inferred that, in this example, the optical energy applied was superfluous.

Comparison Example 7

Except that the energy of flash light was changed into 1 J/cm$^2$, evaluation of the toner was performed in the same manner as that of the above-mentioned embodiment 3. In this example, no voids were generated. However, the fixing performance was 60%, and, thus, poor fixing performance was obtained. It is inferred that, in this example, the optical energy applied was superfluous.

Comparison Example 8

Except that the energy of flash light was changed into 3 J/cm$^2$, evaluation of the toner was performed in the same manner as that of the above-mentioned embodiment 1. In this example, voids were generated. Thus, satisfactory total fixing performance was not obtained. It is inferred that, in this example, the optical energy applied was superfluous.

As shown in the above-mentioned embodiments 6 and 7 and comparison examples 5 through 8, as the color toners according to the embodiments are used, the energy of flash light is set within a range between 0.5 and 2.5 J/cm$^2$ and the light application time is set within a range between 500 and 3000 $\mu$s, the flash fixing processes each requiring the reduced fixing energy can be realized.

Furthermore, as will be described later, the present inventors, etc. considered a product (E·S) of the above-mentioned PAS intensity (S) and the energy (E) of flash light, and, confirmed that excellent fixing of a color toner can be realized when the fixing is made so that this E–S value can satisfy the requirement defined by the following formula (1):

$$0.03 \leqq E \cdot S \leqq 0.15 \quad (1)$$

Figure 4:
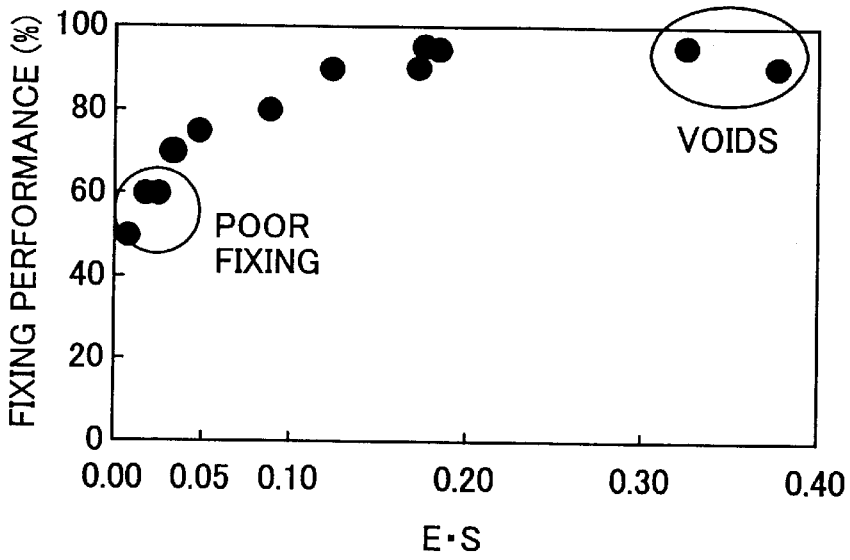
FIG. 4 illustrates a relation between E·S value and fixing performance for each color toner.

The following table shows the E·S values of the satisfactory toners in the above-mentioned embodiments 1 through 7 and non-satisfactory color toners in the comparison examples. Moreover, the relation between the E·S value and the fixing performance is shown in FIG. 4 for these embodiments and comparison examples. It can been seen from FIG. 4 that the fixing performance become insufficient as the E·S value is too low, while, voids are generated as the E·S value is too high. Therefore, it can been seen that it is desirable that the E·S value fall within the range defined by the above-mentioned formula (1).

TABLE 1

| | E (J/cm$^2$) | S | E•S | Fixing Performance (%) | Evaluation |
|---|---|---|---|---|---|
| Embodiment 1 | 1.8 | 0.07 | 0.126 | 90 | ○ |
| 2 | 1.8 | 0.05 | 0.090 | 80 | ○ |
| 3 | 1.8 | 0.02 | 0.036 | 70 | ○ |
| 4 | 1.8 | 0.07 | 0.126 | blue: 90 | ○ |
| | 1.8 | 0.1 | 0.180 | black: 95 | ○ |
| 5 | 1.8 | 0.02 | 0.036 | blue: 70 | ○ |
| | 1.8 | 0.1 | 0.180 | black: 95 | ○ |
| 6 | 0.5 | 0.07 | 0.035 | 70 | ○ |
| 7 | 2.5 | 0.07 | 0.175 | 95 | ○ |
| Comparison Example 1 | 1.8 | 0.005 | 0.009 | 50 | poor fixing |

TABLE 1-continued

| | E (J/cm$^2$) | S | E•S | Fixing Performance (%) | Evaluation |
|---|---|---|---|---|---|
| 2 | 1.8 | 0.21 | 0.378 | 90 | voids |
| 3 | 2.5 | 0.02 | 0.050 | blue: 75 | |
| | 2.5 | 0.13 | 0.325 | black: 95 | voids |
| 4 | 1.8 | 0.095 | 0.171 | 90 | poor saturation |
| 5 | 0.4 | 0.07 | 0.028 | 60 | poor fixing |
| 6 | 3.1 | 0.07 | 0.217 | | voids |
| 7 | 1.0 | 0.02 | 0.020 | 60 | poor fixing |
| 8 | 3.0 | 0.07 | 0.210 | | voids |

As shown in the above-mentioned table 1, the color toners in the embodiments 1 through 7 approximately satisfies the above-mentioned formula (1), while each of the comparison examples approximately does not satisfy the same.

In addition, since the toner in each of the embodiments 4 and 5 and comparison example 3 is of the case where the black toner and the blue toner were fixed simultaneously, it is needed that both toners should be fixed satisfactorily. Therefore, as voids were generated in the black toner in the comparison example 3, the evaluation is non-satisfactory (X).

Figure 5:
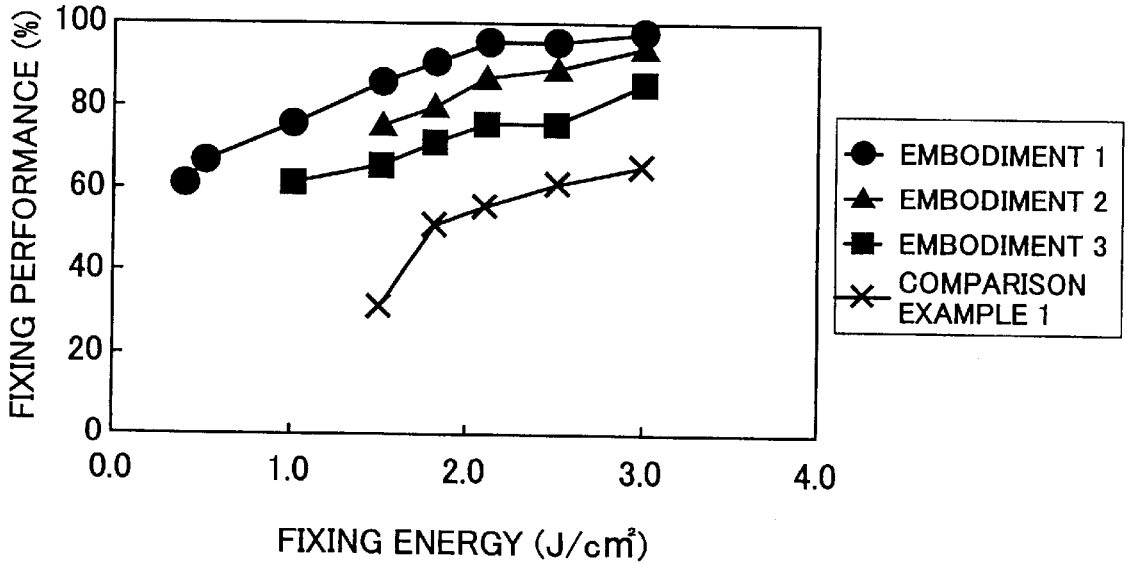
FIG. 5 illustrates a relation between fixing energy (J/cm$^2$) and fixing performance (%) for each color toner.

Furthermore, FIG. 5 shows the fixing performance (%) obtained when the light application time was set to 1500 $\mu$s, and the fixing energy (energy of flash light) was changed.

It can be seen therefrom that, even with the fixing energy lower than 1.75 J/cm$^2$ with which the comparison example 1 provides poor fixing, the color toner of each of the embodiments 1, 2 and 3 provides high fixing performance. That is, it can be seen that use of the color toner according to the present invention can reduce the optical energy required for the flash fixing.

The above-mentioned embodiments of the present invention are examples of toners of blue and black, were actually produced, and fixing examination thereof was performed, as described above. However, application of the present invention is not limited to color toners of blue, but the present invention can also be applied to toners of, for example, red, green, magenta, cyan, and yellow and, thereby, these toners by which positive fixing can be performed, while the optical energy required for the fixing can be effectively reduced, can be provided in the same manner.

Moreover, although the fixing examination according to the two-ingredient development form was performed as described above, a color toner according to the present invention can also be used as a magnetic or non-magnetic single-ingredient toner.

Further, the present invention is not limited to the above-described embodiments, and variations and modifications may be made without departing from the scope of the present invention.

The present application is based on Japanese priority application No. 2001-102439, filed on Mar. 30, 2001, the entire contents of which are hereby incorporated by reference.

What is claimed is:

1. A color toner comprising:

a binding resin;

a colorant; and an infrared absorbent, wherein:

said color toner is fixed on a recording medium by flash light; and a PAS intensity of said color toner obtained from integration of an infrared PAS spectrum obtained according to photoacoustic spectroscopy (PAS) analytical measurement through a range between 800 and 2000 nm falls within a range between 0.01 and 0.2 assuming that the value of carbon black is 1.

2. The color toner as claimed in claim 1, wherein the PAS intensity of said color toner is set in a range between 0.2 and 0.9 times a PAS intensity of a black toner which is fixed simultaneously.

3. The color toner as claimed in claim 1, wherein the PAS intensity of said color toner is set in a range between 0.2 and 5 times a PAS intensity of another color toner which is fixed simultaneously.

4. The color toner as claimed in claim 1, wherein said infrared absorbent comprises at least two infrared absorbents having different absorption wavelength spectrums differs in a range between 800 and 2000 nm in wavelength.

5. The color toner as claimed in claim 4, said at least two infrared absorbents comprise a first infrared absorbent (A) having an absorption peak in a range between 800 and 1100 nm in wavelength and a second infrared absorbent (B) having an absorption peak in a range between 1100 and 2000 nm in wavelength used together.

6. The color toner as claimed in claim 5, wherein said infrared absorbent (A) comprises a compound of naphthalocyanine family, and said infrared absorbent (B) comprises a compound of aminium family or a compound of diimonium family.

7. An image forming method comprising the steps of:

a) applying flash light to a color toner which comprises at least a binding resin, a colorant and an infrared absorbent; and b) thereby fixing said color toner onto a recording medium, wherein a PAS intensity (S) of said color toner obtained from integration of an infrared PAS spectrum obtained according to photoacoustic spectroscopy (PAS) analytical measurement through a range between 800 and 2000 nm and an optical energy (E) of the flash light satisfy a requirement of the following formula (1):

$$0.03 \leqq E \cdot S \leqq 0.15 \quad (1).$$

8. An image forming method comprising the steps of:

a) applying flash light to a color toner which comprises at least a binding resin, a colorant and an infrared absorbent; and b) thereby fixing said toner onto a recording medium, wherein an energy of the flash light is set in a range between 0.5 and 2.5 J/cm$^2$, and a light application time thereof is set in a range between 500 and 3000 $\mu$s.

* * * * *